United States Patent [19]

Wilson

[11] Patent Number: 4,750,589

[45] Date of Patent: Jun. 14, 1988

[54] ELEVATOR LEVELING CONTROL

[76] Inventor: Chester K. Wilson, 1302 Turtle Cove, Manchester, Mo. 63011

[21] Appl. No.: 59,623

[22] Filed: Jun. 8, 1987

[51] Int. Cl.[4] ..... B66B 1/04

[52] U.S. Cl. ..... 187/29.2

[58] Field of Search ..... 187/110, 111, 29.2

[56] References Cited

U.S. PATENT DOCUMENTS 3,056,469 10/1962 Wilson ..... 187/29.2

3,955,649 5/1976 Takenoshita et al. ..... 187/110

*Primary Examiner*—William M. Shoop, Jr.

*Assistant Examiner*—W. E. Duncanson, Jr.

*Attorney, Agent, or Firm*—Polster, Polster and Lucchesi

[57] ABSTRACT

An elevator leveling control for a system described in U.S. Pat. No. 3,056,469, includes a leveling cylinder and piston arrangement responding to less pressure than the main control cylinder and piston, so that during the operation of the main cylinder and piston, the leveling piston is always in its uppermost position, and a leveling cam, carried by the leveling cylinder-piston arrangement produces the minimum resistance in a rheostat electrically connected to the control field of a generator supplying power to the elevator motor. Through the travel of the elevator in high speed, the leveling rheostat is disconnected from the control field and the main rheostat is connected. At a given distance from the floor at which the elevator is to stop, a valve in the hydraulic system is energized to close, holding the main rheostat from dropping farther, the main rheostat is disconnected and the leveling rheostat is electrically connected to the generator control field. The leveling cam then acts to increase the resistance in the control field of the generator to bring the car smoothly and accurately to its rest position.

5 Claims, 2 Drawing Sheets

ELEVATOR LEVELING CONTROL

BACKGROUND OF THE INVENTION

The present invention is an improvement on the elevator control system illustrated and described in U.S. Pat. No. 3,056,469. In that system, the leveling was essentially provided in case the elevator car overshot the floor level. In that situation, a leveling pump was energized to pump a small amount of hydraulic fluid into a main cylinder, which, when it began to rise, removed some resistance from the variable voltage generator, causing the elevator motor to operate until the elevator reached its position level with the floor. However, this was a relatively slow process, and the system itself did not provide means for assuring accurate leveling as the car approached the floor at which it was to stop.

One of the objects of this invention is to provide a leveling system that is energized as a part of the control system, at each floor, so as to reduce or eliminate the problem of overshooting.

Other objects will become apparent to those skilled in the art in the light of the following description and accompanying drawings.

SUMMARY OF THE INVENTION

In accordance with this invention, generally stated, an improved leveling system is provided for the elevator control illustrated and described in U.S. Pat. No. 3,056,469. In the system of that patent, a main cylinder C1 and piston PT3 are operatively connected in a hydraulic line between a constant volume pump P1 and a variable volume pump P2, to control a main rheostat R1, elecrically connected to the control field of a variable voltage generator supplying power to the elevator motor. In the present invention, a leveling rheostat is controlled by a cylinder-piston arrangement operatively connected in the same hydraulic system, between the pumps P1 and P2. The, leveling cylinder-piston arrangement responds to a lesser pressure than the main cylinder-piston, so that the piston in the leveling cylinder moves to its uppermost or most extended position before the main piston begins to move in the main cylinder. In that position, the leveling piston has removed the maximum amount of resistance from the leveling rheostat, in the same way in which the upward movement of the main piston removes the resistance from the main rheostat. The leveling rheostat is removed from the generator control field until the elevator reaches a predetermined position near the floor at which it is to stop. During that amount of travel, the elevator control of U.S. Pat. No. 3,056,469 operates in the manner in which that patent describes. However, when the elevator reaches the prescribed position in its travel toward the floor, the main rheostat is removed from the circuit and the leveling rheostat is connected. The leveling piston moves down rapidly but smoothly in response to the operation of the variable volume pump P2 until the elevator is level. Ordinarily, there will be no overshooting with this system. If there should be, then the leveling pump of the patent will be energized, which, because the leveling piston moves in response to a lesser pressure, will act more quickly to level the car.

DESCRIPTION OF THE PREFERRED EMBODIMENT

Figure 1:
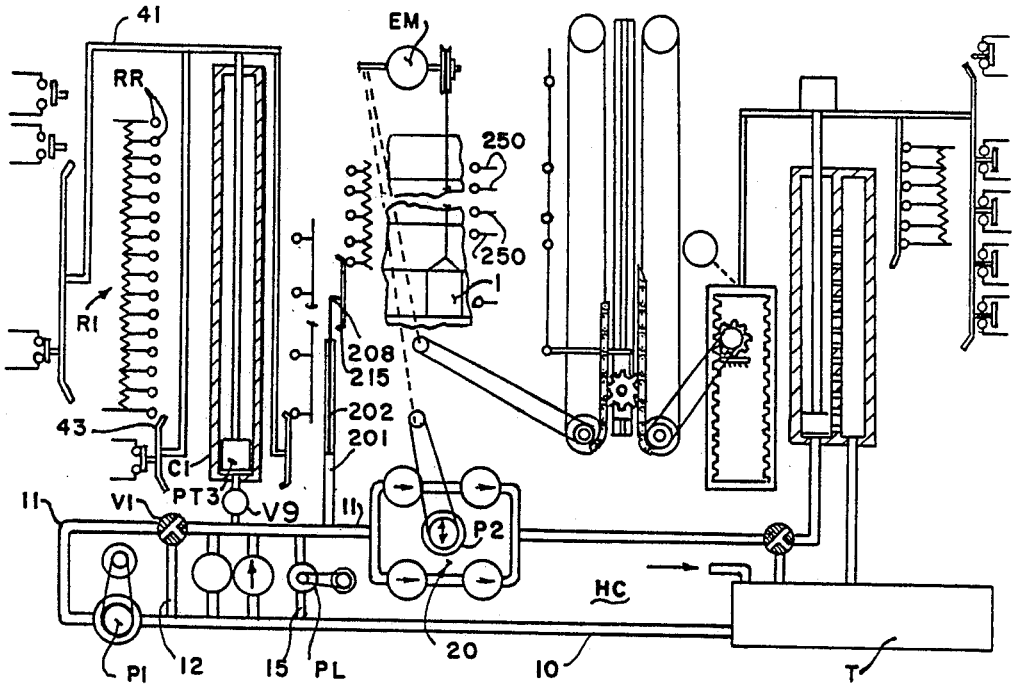
FIG. 1 is a schematic layout of a preferred embodiment of the system of this invention.

Except for certain of the elements that are essential to the operation of the leveling system of this invention, the improvements of the drawings, which are identical with those is U.S. Pat. No. 3,056,469, will not be labeled. Refering now to FIG. 1 for one illustrative embodiment of leveling system of this invention, reference numeral 1 indicates an elevator car raised and lowered by a direct current elevator motor EM with an armature 110 connected to an armature 113 of a variable voltage, direct current generator, as shown in FIG. 2.

A hydraulic system includes a reservoir T of hydraulic fluid, and a hydraulic conduit generally designated as HC, which includes a constant volume pump P1 and a variable volume pump P2.

A conduit 10 connects the reservoir T and the constant volume pump P1. A conduit 11 and a three-way valve V1 connects the constant volume pump P1 to a cylinder C1. In this embodiment, an electrically operated valve V9 is in a line between the conduit 11 and the cylinder C1. The conduits 10 and 11 are connected, among other ways, through a conduit 12 and the three-way valve V1, and a conduit 15 and the pump of a car leveling motor-pump combination PL. The conduit 11 is connected to a conduit bridge arrangement designated generally at 20, permitting fluid from the variable volume pump P2 to flow only in the direction of the tank T. In this embodiment, a leveling cylinder 201 is connected to the conduit 11 between the valve V1 and the conduit bridge 20.

As is explained in detail in U.S. Pat. No. 3,056,469, the cylinder C1 has in it a piston PT3, operating a yoke 41 that carries a cam 43. The cam 43 serves to introduce and remove resistance from a main rheostat R1, by wiping contacts RR. The rheostat R1 is connected to a control circuit of the variable voltage generator armature 113.

In this embodiment, a piston 202, slidably mounted in the cylinder 201, carries a yoke 208, which, in turn, carries a leveling rheostat cam 215, which wipes contacts 220 of a leveling rheostat 230. The leveling rheostat 230 is electrically connected, parallel to the rheostat R1, to the control field for the generator armature 113, although the rheostats R1 and 230 are never in the circuit at the same time.

Figure 2:
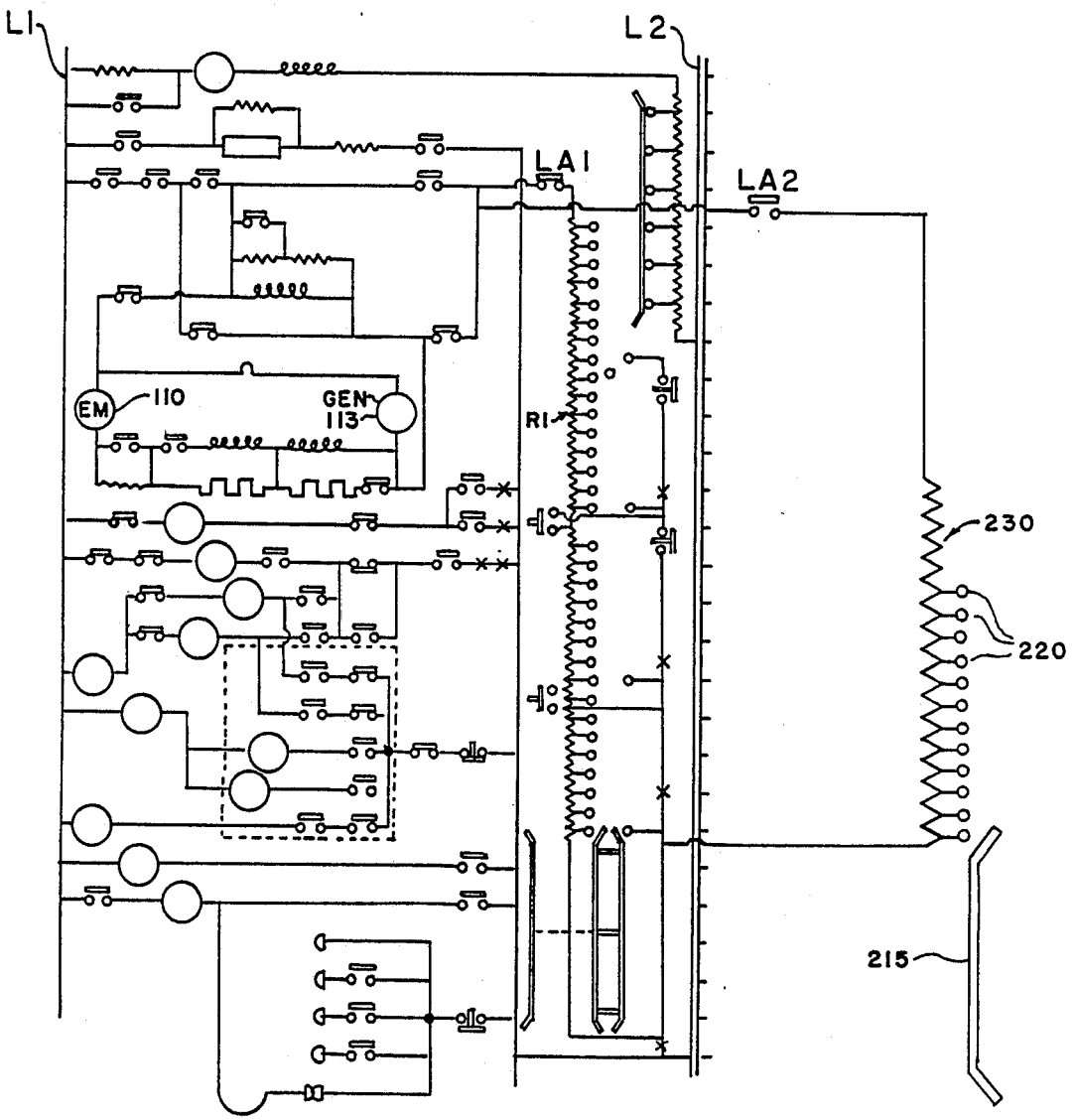

As shown somewhat exaggeratedly in FIG. 1, the cylinder 201 and its accompanying piston 202 are smaller than the cylinder C1 and piston PT3, and the piston 202 and yoke 208 are lighter than their conterparts in the main cylinder assembly. Accordingly, they respond to a lesser fluid pressure than does the piston PT3, and the piston 202 will rise to its uppermost position before the main piston PT3 begins to move upwardly. The upward movement of the leveling piston 202 is limited by a suitable rubber or other resilient bumper.

In this embodiment, there are three leveling switches, a normally closed switch LA1, a normally open switch, LA2 and a valve control switch LA3. The switch LA1 is in the circuit between the main rheostat R1 and the generator field control circuit. The switch LA2 is in the circuit between the leveling rheostat 230 and the generator field control circuit, and the switch LA3 is in series with the valve V9 between the power supply lead L1 and the return power supply lead L2.

During the travel of the elevator car 1 between floors, until it reaches a predetermined point, for example eighteen inches, from the floor at which it is to stop, the circuit is in the condition shown in FIG. 2. At that point, a sensor 250 operates to open the switch LA1 and close the switch LA2, and to close the switch LA3. The closing of the switch LA3 energizes the valve V9 to close the conduit between the conduit 11 and the cylinder C1 so that the operation of the elevator motor is now dependent upon the operation of the cylinder 201 and piston 202, and the leveling rheostat 230. As is indicated in FIG. 2, the rheostat 230 has a fixed resistance sufficient to insure that the elevator moves at the rate of speed at which it was moving when the switches LA1, LA2, and LA3 were actuated. In response to the action of the variable volume pump P2, the constant volume pump P1 being ineffective as explained in the patent, the piston 202 moves downwardly, increasing the resistance in the leveling rheostat and further slowing the elevator until it reaches the level at which the elevator motor stops and the brake is set. If the elevator car should overshoot, the leveling pump PL is energised. The piston 202 will respond more quickly than the piston PT3, but as in the case of the leveling described in the patent, the operation of the elevator motor will cause the variable volume pump P2 to exhaust the fluid from the cylinder 201 so that a balance is reached.

The leveling system of this invention insures that, except under extraordinary circumstances, the car will neither stall in the leveling zone nor overshoot. When the car has reached level at the desired stop, the system resets itself, as described in U.S. Pat. No. 3,056,469.

Merely by way of illustration, if the main rheostat piston PT3 operates on thirteen pounds of pressure, the leveling rheostat piston 202 can operate on nine pounds of pressure. If the main rheostat cam 43 travels twenty-eight inches, the leveling rheostat cam 215 can move up nine inches, bridging eighteen rheostat contacts 220 in the process when it is fully extended, eighteen contacts giving an eighteen step, smooth deceleration in the last eighteen inches of travel of the elevator car.

Figure 3:
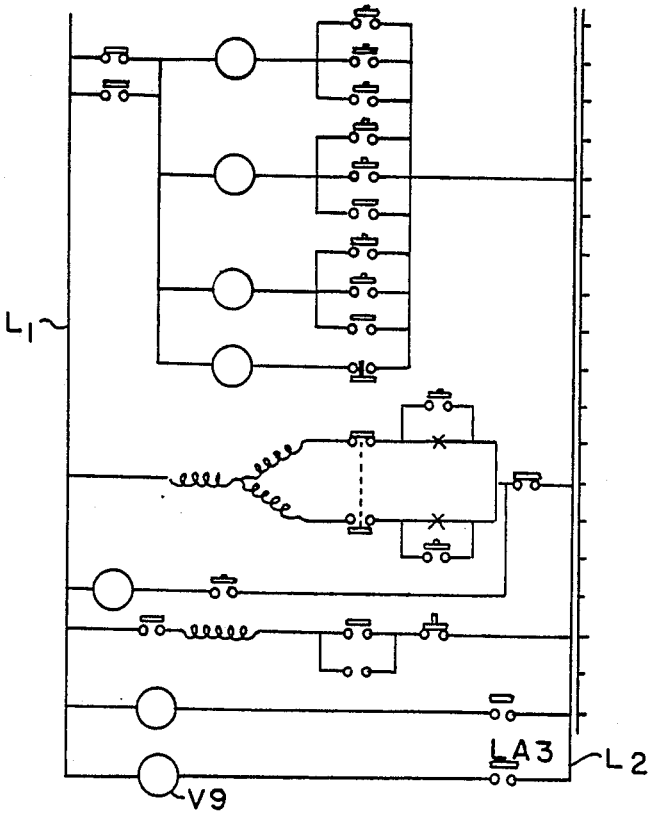
FIGS. 2 and 3 are schematic diagrams of control circuits incorporating a leveling circuit of this invention.

In an elevator moving at 1200 feet per minute, the signal can be picked up thirty feet from the floor; the stop indication relay SS (see FIGS. 2 and 3 of U.S. Pat. No. 3,056,469) closes which closes valve V1, cutting off the constant volume pump P1 from the main rheostat cylinder C1 and causing the main rheostat piston PT3 to fall in response to the exhaustion of hydraulic fluid from the cylinder C1 by the operation of the variable speed pump P2. When the car is eighteen inches from the floor, valve V9 closes, preventing further dropping of the piston PT3. However, as has been explained, the main rheostat is then disconnected from the circuit and the leveling rheostat is connected. The leveling pump PL is driven at a rate to inject enough oil into the leveling cylinder to move the leveling cam to a position at which the generator causes the balanced car to move at a low rate, for example, five feet per minute. Thus the car will never stall in the leveling zone.

Numerous variations in the construction of the leveling system of this invention, within the scope of the appended claims, will occur to those skilled in the art in the light of the foregoing disclosure. By way of illustration but not of limitation, the strokes of either or both of the cylinder-piston arrangements can be made longer or shorter. Other arrangements of yoke and cam or shoe can be used. The resistance of one or both rheostats can be varied in response to the movement of the piston-cylinder arrangements by rotating a pot arm or the like. These are merely illustrative.

I claim:

1. In an elevator control which includes, in combination, an elevator car that serves a plurality of floors; an electric elevator drive motor; a variable voltage generator electrically connected to the motor for driving said motor, said generator having a control field; a main rheostat connected to control flow of current in the control field; a hydraulic system, including a reservoir of hydraulic fluid, means for circulating said hydraulic fluid through said hydraulic system including a constant volume pump and a variable volume pump, said variable volume pump circulating an amount of fluid proportional to the speed of said motor, main control means responsive to the pressure in said hydraulic system, intermediate said constant volume and said variable pumps, said pressure responsive control means comprising a piston and cylinder arrangement movable with respect to each other and controlling the movement of a cam; a main rheostat, said control means cam being adapted to control the value of resistance of said rheostat, said rheostat being electrically connected to control flow of current in the control field of said generator, and means for providing a stopping signal for said elevator car, the improvement comprising leveling means responsive to a lesser pressure in said hydraulic system than said main rheostat cam controlling means, said leveling means comprising a piston and cylinder arrangement operatively connected to said hydraulic system between said constant volume pump and said variable volume pump, moveable with respect to each other and controlling the movement of a leveling cam, a leveling rheostat, said rheostat being electrically connected to control flow of current in the control field of said generator when said main rheostat is removed from said circuit, said leveling cam being adapted to control the value of resistance of said leveling rheostat, and means for disconnecting said main rheostat from and connecting said leveling rheostat to said generator control field in response to the approach of said elevator car to a floor at which the elevator is to stop.

2. The improvement of claim 1 wherein the leveling rheostat is provided with discrete spaced contacts and said leveling cam is arranged to wipe said contacts successively as said piston and cylinder arrangement moves in response to hydraulic fluid in said cylinder, said cam causing the value of resistance in said leveling rheostat to be at a minimum when said piston and cylinder are fully extended with respect to one another in response to pressure in said hydraulic system.

3. The improvement of claim 1 including normally open valve means actuable to cut off said control cylinder from said hydraulic system while leaving said leveling cylinder operatively connected to said hydraulic system and means operative when said car reaches a predetermined position relative to the floor at which it is to stop for actuating said valve means.

4. The improvement of claim 3 including a leveling pump in said hydraulic system with a suction side connected to a supply conduit in said hydraulic system and a discharge side connected to a reach of conduit in said hydraulic system to which reach the said control cylinder and leveling cylinder are connected at spaced locations, said leveling pump discharge side being connected between said control cylinder and said leveling cylinder.

5. The improvement of claim 4 wherein the leveling pump is adjusted to inject enough hydraulic fluid into the leveling cylinder to cause the balanced car to move at a rate on the order of five feet per minute, whereby the car will not stall in the leveling zone when overloaded.

* * * * *